US006516575B2

(12) United States Patent
Haab et al.

(10) Patent No.: US 6,516,575 B2
(45) Date of Patent: Feb. 11, 2003

(54) DEVICE FOR LOCKING RUNNING GEAR GUIDED IN RAILS

(75) Inventors: Karl Haab, Weggis (CH); Otto Haab, Mettmenstetten (CH)

(73) Assignee: Hawa AG, Mettmenstetten (CH)

( * ) Notice: Subject to any disclaimer, the term of this patent is extended or adjusted under 35 U.S.C. 154(b) by 0 days.

(21) Appl. No.: 10/080,684

(22) Filed: Feb. 25, 2002

(65) Prior Publication Data

US 2002/0178668 A1 Dec. 5, 2002

(30) Foreign Application Priority Data

Apr. 6, 2001 (EP) ..... 01810343

(51) Int. Cl.[7] ..... E04H 1/00; E04B 7/16; E05D 15/06

(52) U.S. Cl. ..... 52/243.1; 52/64; 52/71; 160/196.1

(58) Field of Search ..... 52/241, 243.1, 52/71, 64; 292/DIG. 46, 173, 38; 160/196.1, 199, 206; 16/87.6 R, 87 R, 87.2, 99; 49/409

(56) References Cited

U.S. PATENT DOCUMENTS 212,015 A * 2/1879 King ..... 292/173
1,411,625 A * 4/1922 Gullage ..... 292/169.21
3,292,321 A * 12/1966 Schans ..... 52/241
3,798,839 A * 3/1974 Kaufman ..... 160/199
3,984,136 A * 10/1976 Bills ..... 292/182
4,574,862 A * 3/1986 Rejc ..... 160/199
4,872,287 A * 10/1989 Block ..... 16/87 R
5,499,671 A * 3/1996 Owens ..... 16/94 R
5,577,348 A * 11/1996 Keller ..... 160/40
6,052,867 A * 4/2000 Haab et al. ..... 16/87 R

FOREIGN PATENT DOCUMENTS

BE 466 936 A 7/1946
WO WO 00/55460 9/2000

* cited by examiner

*Primary Examiner*—Carl D. Friedman
*Assistant Examiner*—Kevin McDermott
(74) *Attorney, Agent, or Firm*—Oliff & Berridge, PLC

(57) ABSTRACT

The device (2), which is used to lock running gear (1) guided in a rail (5) and is or can be connected to the latter, has a body (21, 22) in which a locking pin (23) is displaceably mounted and, by means of a resilient element (24), is held resiliently in a first position, so that the locking pin (23) can be brought by the action of a force from the first position, in which it can engage in a locking element (36, 53) provided in the rail (5) or connected to the rail (5), into a second position, in which it is released from the engagement in the locking element (36, 53). The locking device (2), which is constructed simply and cost-effectively, therefore permits dividing elements (90), such as sliding doors, sliding counters or folding walls, which are guided by the running gear (1), to be closed off securely.

12 Claims, 4 Drawing Sheets

DEVICE FOR LOCKING RUNNING GEAR GUIDED IN RAILS

BACKGROUND OF THE INVENTION

1. Field of the Invention

The invention relates to a device for locking running gear guided in rails, according to the preamble of patent claim 1.

2. Description of Related Art

For the purpose of dividing or styling rooms or in order to close off room or window openings, use is often made of glass or wooden walls, screens, doors or counters, which are fixed and possibly rotatably mounted on running gear which can be displaced along a rail.

Normally, these parts, referred to below as dividing elements, can be displaced between two end positions, at which the running gear strikes a buffer device provided in the rail.

A buffer device of this type, which is shown in FIG. 8 and described in EP 0 733 766 A2 and WO 00/55460, has a buffer element 031 which is locked in the rail 5 by means of a mounting screw 035. The buffer element 031 bears a resilient part 037, which serves as an end stop for the body 11 of the running gear 1. A spring element 036 is also held by the buffer element 031 and, with the running gear 1, forms a snap-in connection as soon as said running gear strikes the resilient part 037. In the process, the bent spring element 036 is lifted over a central part of a running wheel 13 belonging to the running gear 1 and clamps the latter firmly as soon as the running gear 1 reaches the resilient part 037.

In order to displace a dividing element 90 which is firmly held in this way and, in the configuration of FIG. 8, is connected to the running gear 1 by a fixing device 91 and a connecting screw 15, the dividing element 90 is firstly released with a small push or jolt.

The device described is therefore suitable for holding dividing elements but not for firmly locking or closing them.

In order to close off rooms in a secure manner, dividing elements are therefore often provided with bolts or sliders which, in the closing position of the dividing elements, can be displaced, for example, in closure devices connected to the masonry.

However, the mounting of closure devices on internal or external walls made of masonry entails a considerable amount of work. Because of the relatively soft insulating materials which are used nowadays and which are applied to the masonry, it is barely possible for closures or closing plates, etc., to be anchored to the masonry with the required stability. Therefore, providing reliable security against unpermitted access can barely be achieved by means of these closing devices. In addition, closures or closing plates which are mounted on the masonry for the most part appear to be esthetically disruptive.

For the purpose of subdividing relatively large rooms, halls or auditoriums, use is also made of foldable dividing elements 902, 903, 904 which are connected to one another by means of hinges 905, as shown in FIG. 9. These dividing elements 902, 903, 904 are locked by being aligned in a straight line and, for example, being locked by means of a door lock 906 after an associated door 901 has been closed. This design with a closeable door is likewise very complicated and often does not meet the existing requirements. The use of closures or closing plates which are mounted on the masonry is also possible in the case of the foldable dividing elements 902, 903, 904, but is afflicted by the same disadvantages.

The right-hand dividing element 904 can also be connected, by means of hinges 905, to an adjacent frame 1000. However, in this case it can no longer be displaced.

SUMMARY OF THE INVENTION

The present invention is therefore based on the object of providing a device for locking running gear guided in rails which is not afflicted with the deficiencies described.

This object is achieved with a device which has the features specified in claim 1. Advantageous refinements of the invention are specified in further claims.

The device according to the invention, which is used to lock running gear guided in a rail and is or can be connected to the latter, has a body in which a locking pin is displaceably mounted and, by means of a resilient element, is held resiliently in a first position, so that the locking pin can be brought by the action of a force from the first position, in which it can engage in a locking element connected directly or indirectly to the rail, into a second position, in which it is released from the engagement in the locking element.

The locking device, which is constructed simply and cost-effectively, therefore permits the secure closure of dividing elements, such as sliding doors, sliding counters or folding walls, which are guided by the running gear. The device can be actuated in a simple way, manually or electromagnetically. It is particularly advantageous that parts of the closing or locking device, such as closing or locking plates, no longer have to be mounted on the masonry but are integrated in the rail.

The locking element can be part of the rail which is present in any case or, preferably, of a buffer device which is mounted in the rail and which normally stops a dividing element in the position in which it is also to be closed. The solution according to the invention therefore combines the locking and closing and the buffer function in one configuration.

By means of a possible form-fitting connection between locking device and locking element, reliably secured closure of dividing elements is achieved. This results in reliable intrusion protection, without a lock being needed.

The locking device can also be mounted subsequently, avoiding material-removal machining, on ironmongery components or on the body of an item of running gear.

The locking device and the associated locking element are located within the running rail and therefore do not appear to be disruptive either. The part for the manual operation of the locking device, a line, a cord or a chain, is mounted on the locking device and is automatically pushed away when it is opened and then cannot be seen or gripped from the outside either. Furthermore, electromagnetic actuation of the locking device is possible, which permits the central control of the locking devices.

In a preferred refinement, provision is also made that the locking device can be changed over in a simple way between a first state, in which the locking device always closes automatically, and a second state, in which the locking device does not close.

BRIEF DESCRIPTION OF THE DRAWINGS

The invention will be explained in more detail below using drawings, in which.

DETAILED DESCRIPTION OF THE PREFERRED EMBODIMENTS

Figure 1:
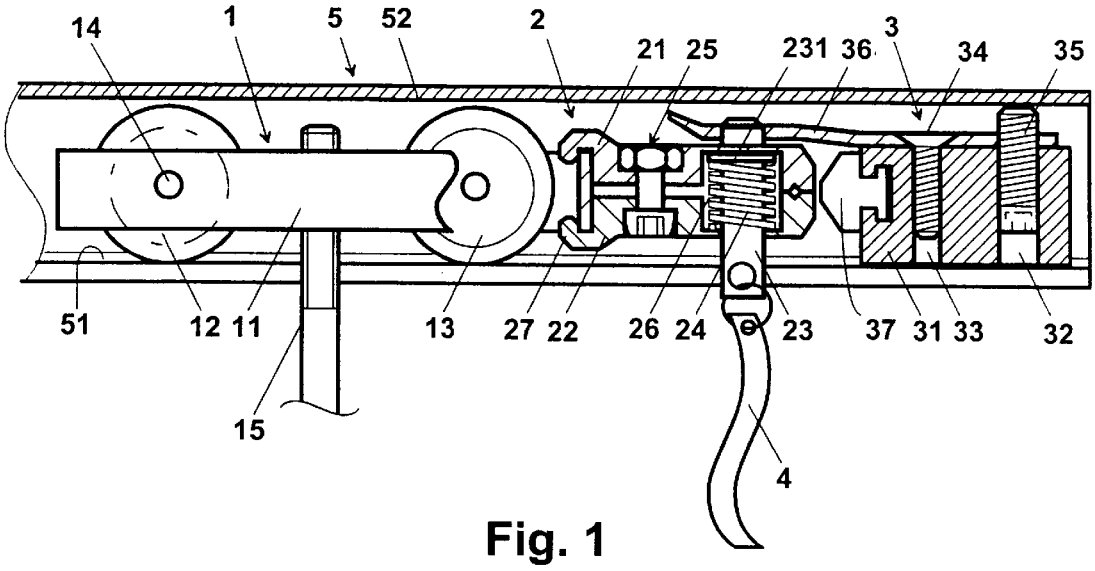
FIG. 1 shows a rail 5, illustrated in section, in which an item of running gear 1 with a locking device 2 to be actuated manually has been guided against a buffer device 3 and held by the latter.

FIG. 1 shows a rail 5, illustrated in section, in which an item of running gear 1 connected to a dividing element via a connecting screw 15 is guided and is connected to a locking device 2 to be actuated manually. The running gear 1, which has a running-gear body 11 and two wheels 12 and 13 which run on running surfaces 51 of the rail 5 and are mounted by means of axials 14 are located at the right-hand stop, formed by a buffer device 3, belonging to the running path.

Figure 4:
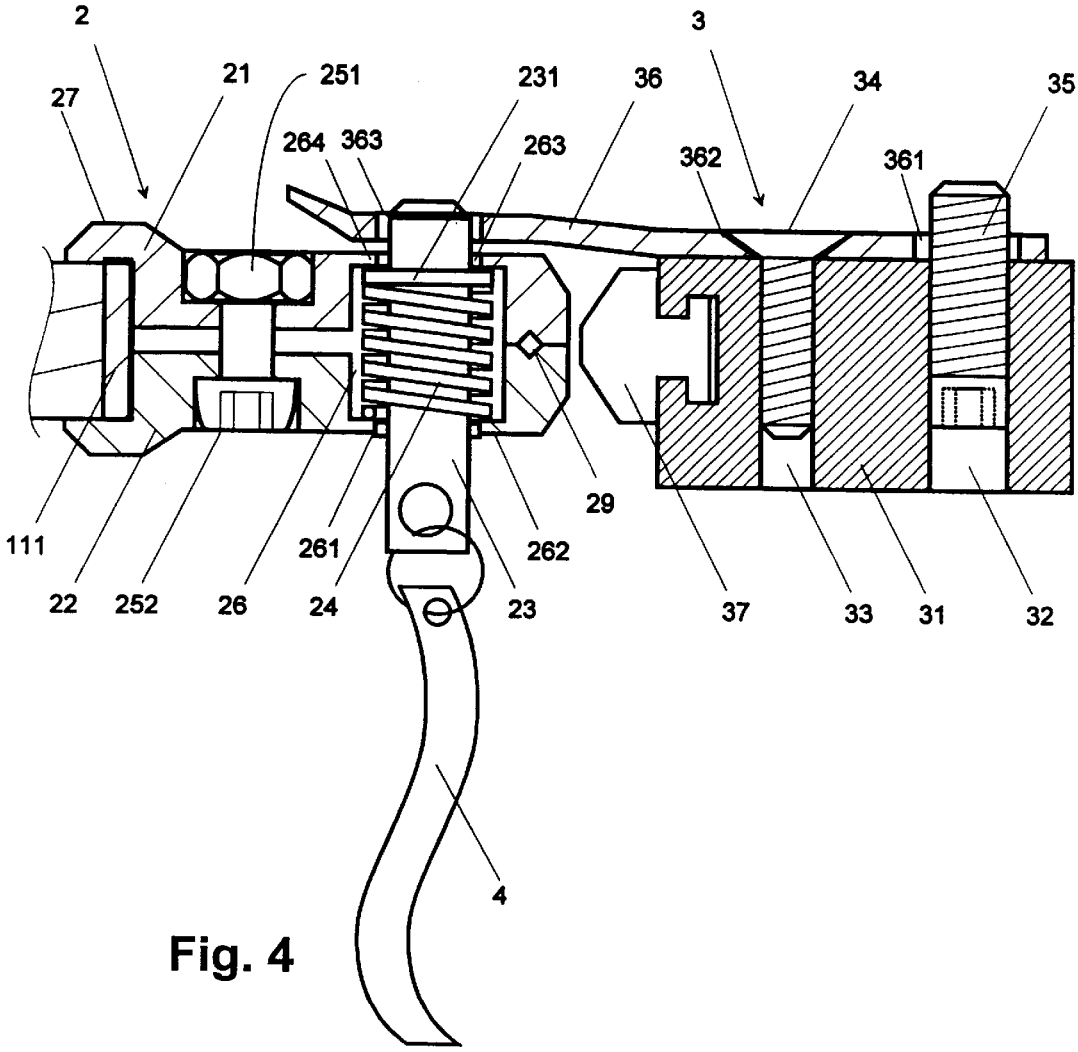
FIG. 4 shows the locking device 2 and the buffer device 3 in detail.

The body of the locking device 2 comprises two parts 21 and 22 which are connected to each other by means of connecting means 25 or by means of a screw 252 and a nut 251 and have tongs-like clamping elements 27 (see FIG. 4), which clamp firmly around the running-gear body 11 and are therefore rigidly connected to the latter. For the purpose of mutual fixing, the parts 21 and 22 preferably have an anchoring means 29 on the sides located opposite the clamping elements 27.

The two mutually connected parts 21, 22 of the locking device 2 form a chamber 26, which is provided with openings 261, 263 which are used to lead a locking pin 23 through, have a smaller diameter than the chamber 26 and therefore are enclosed by a first and a second inwardly directed flange 262, 264.

Within the chamber 26 closed off on either side by a flange 262, 264 in each case, there is arranged a spring element or a spiral spring 24 that encloses the locking pin 23, on one side bears on the first flange 262 and on the other side presses a collar 231 connected to the locking pin 23 against the second flange 264 and thus holds the locking pin 23 resiliently in a first position, in which it can engage in a locking element 36. The locking pin 23, displaceably mounted in the openings 261, 263, can therefore be displaced out of the first position only by means of the action of an external force into a second position, in which it is released from the engagement in the locking element 36.

The chamber 26 and the collar 231 guided therein and belonging to the locking pin 23 preferably have a rectangular cross section, so that the locking pin 23 cannot rotate and cant during the axial displacement. As a result of this simple measure, therefore, fault-free operation of the device is ensured.

For the purpose of manual actuation, the locking pin 23 is connected to a line 4, but the use of a cord or a chain is also possible, by means of which the locking pin 23 can be displaced axially. During the displacement of a dividing element 90 connected to the running gear 1, the line 4 is guided along with it (see FIG. 8) and can thus neither be seen nor gripped from the outside.

In the preferable refinement of the invention shown in FIG. 1, the locking element 36 is connected to the buffer device 3 by means of a fixing screw 34, as a result of which the locking and closing and the buffer functions are combined in one configuration. To this end, the buffer device 3 anchored within the rail 5 by means of a mounting screw 35 has a resilient part 37, which the locking device 2 connected to the running gear 1 in each case strikes when the end is reached.

Figure 2:
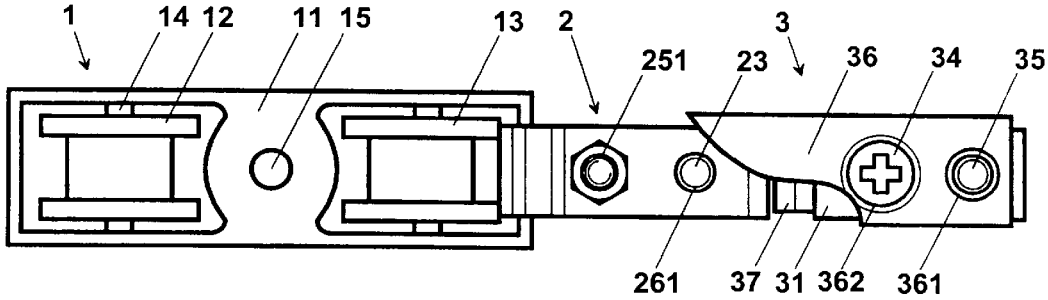
FIG. 2 shows the running gear 1 with the locking device 2 and the buffer device 3 from above, with a plate-like locking element 36, illustrated in section, which is connected to the buffer device 3 by means of a fixing screw 34.
Figure 3:
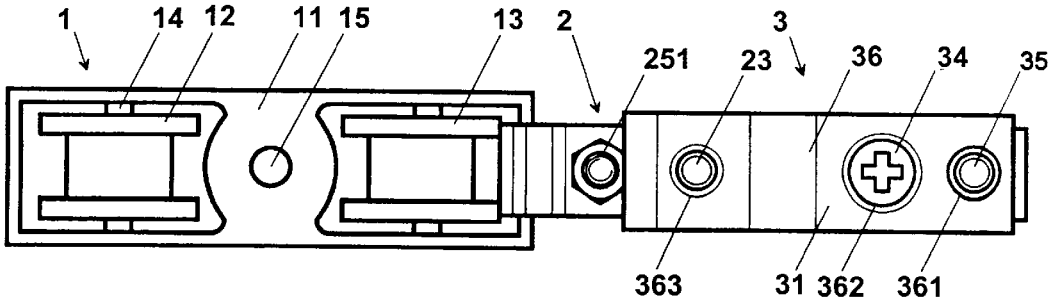
FIG. 3 shows the running gear 1 with the locking device 2 and the buffer device 3 from above with the locking element 36, which projects partly beyond the locking device 2 and is held by a locking pin 23.

As shown in FIGS. 2 and 3, the locking element 36 aligned toward the locking device 2 has a plate-like or tongue-like configuration and is mounted in such a way that, after the locking device 2 has struck the buffer device 3, the locking pin 23 can penetrate into an opening 363 provided in the locking element 36. The running gear 1 with the locking device 2 is therefore stopped and then held by means of the buffer device 3.

The part of the locking element 36 that faces the running gear 1 is preferably inclined upward in such a way that the locking pin 23 moves in under said part, forces it upward or is forced downward by it until it can penetrate into the opening 363.

The buffer device 3, which has a threaded hole 32 to accommodate the mounting screw 35 and a threaded hole 33 to accommodate the fixing screw 34 serving to fix the locking element 36, is pressed against the running surfaces 51 of the rail 5 and thus locked by means of the mounting screw 35 guided through a hole 361 in the locking element 36 and against the central piece 52 of the rail 5. By loosening the mounting screw 35 guided through a hole 361 in the locking element 36, and by displacing the buffer device 3, the closing position of the dividing element can be fixed precisely.

As a result of the form-fitting engagement of the locking pin 23 in the locking element 36, reliably secured closure of the dividing element is achieved. This results in reliable intrusion protection, without a lock being needed. The locking device 2 and the locking element 36 are arranged within the rail 5 and are therefore barely visible to the user.

Figure 8:
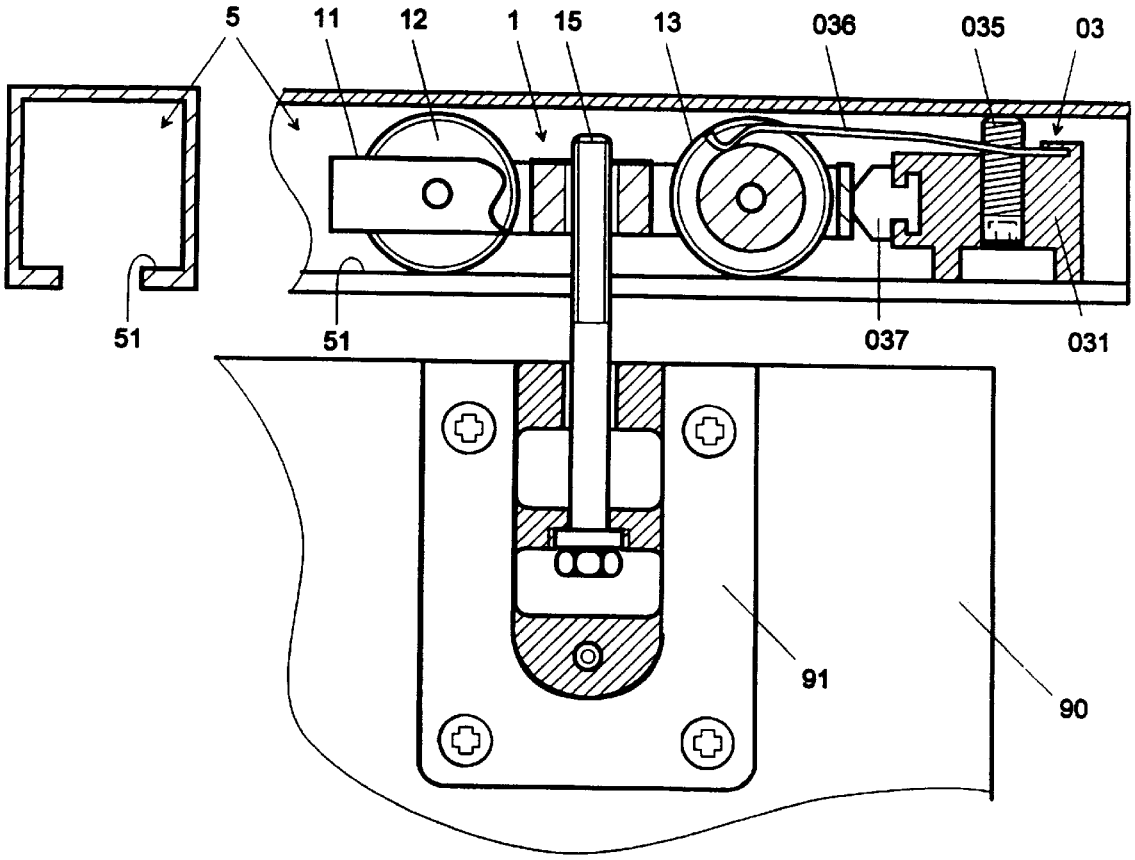
FIG. 8 shows a known device, comprising a rail 5 and an item of running gear 1, for guiding a dividing element 90.
Figure 9:
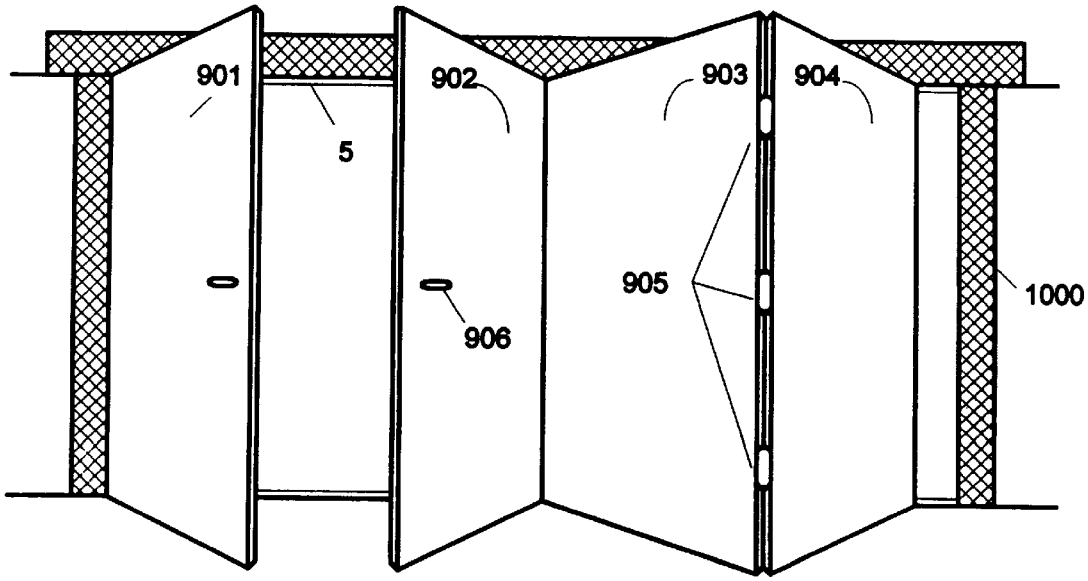
FIG. 9 shows foldable dividing elements 902, 903 and 904 which, together with a door 901, are used to close off or divide a room.

A guide system having an item of running gear 1 and a buffer device 3, as are shown in FIG. 8, can also subsequently be provided in a simple way with a locking device 2.

Figure 5:
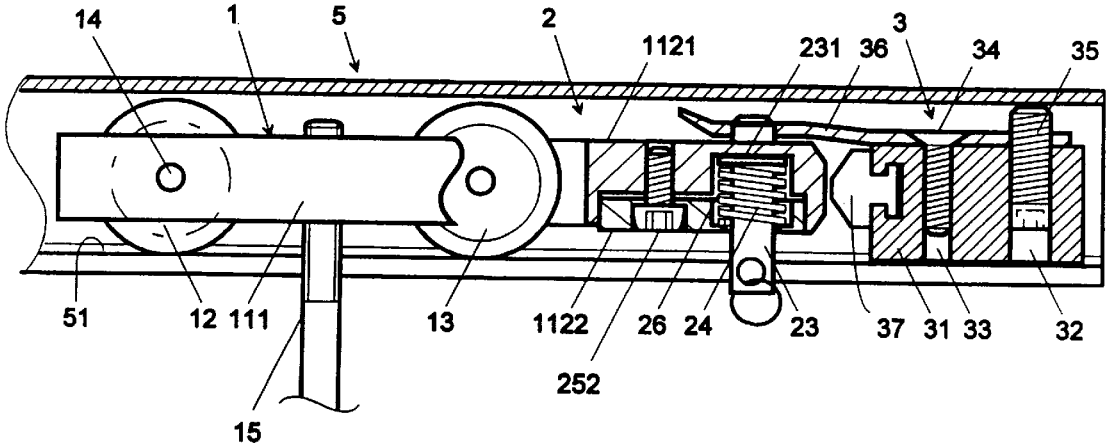
FIG. 5 shows an item of running gear 1 with integrated locking device 2.

As FIG. 5 shows, however, the locking device 2 can also advantageously be integrated in running gear 1. A first part 1121 of the locking device 2, serving to accommodate the locking pin 23 and the spiral spring 24 in a chamber 26, is connected to the body 111 of the running gear 1 and is preferably fabricated in one casting with the latter. The chamber 26 is closed by a second, thinner part 1122, which is connected to the first part 1121 by means of a screw 252. The device shown in FIG. 5, comprising running gear 1 and a locking device 2, can therefore be constructed to be still more compact and more stable.

Figure 6:
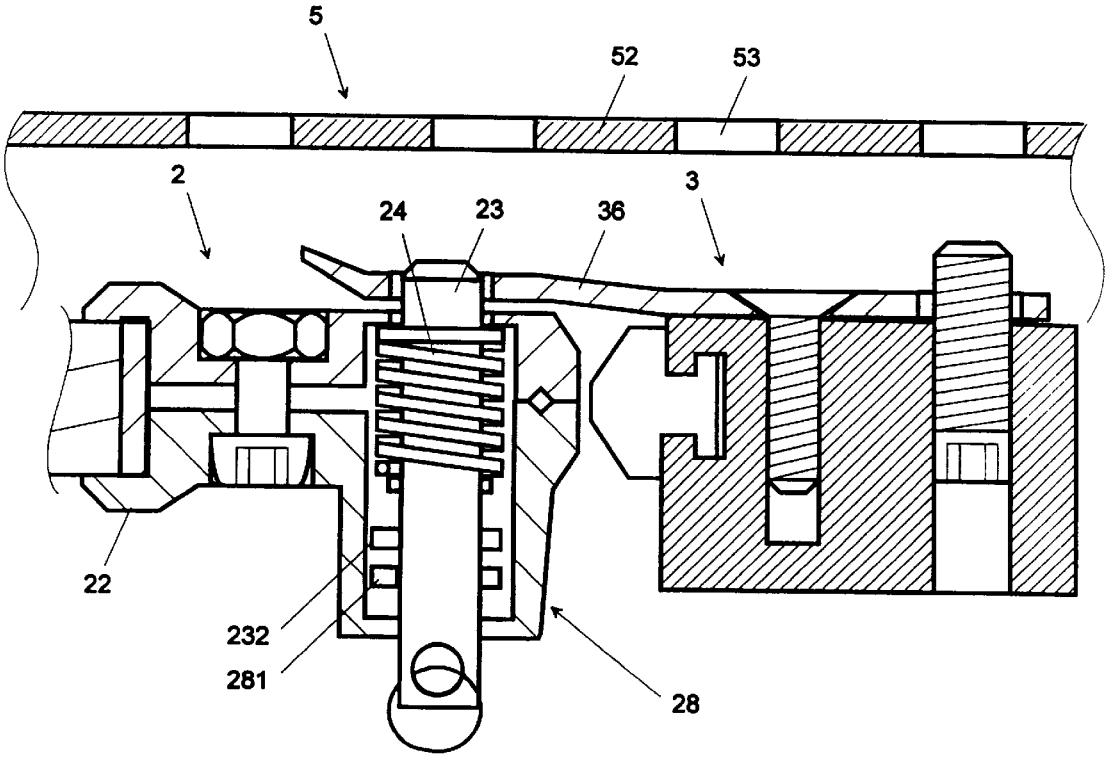
FIG. 6 shows a locking device 2 which can be changed over manually between a first state, in which the locking device 2 always closes automatically, and a second state, in which the locking device 2 does not close.

FIG. 6 shows the locking device 2 to be actuated manually in a preferable refinement, in which the locking pin 23 can be changed over between at least two positions. To this end, a mechanism 28 having at least one retaining element 281 is provided, and is used to hook in cams 232 connected to the locking pin 23. By means of pulling the locking pin 23, it is hooked into the retaining element 281, and released again by being pulled again. Mechanisms of this type are used, for example, in ball-point pens. The locking device 2 can therefore be deactivated in this way, so that the relevant dividing element can be displaced as far as the end stop without being locked. Only when the dividing element is to be locked is the locking pin 23 unlocked and set back into the first position.

FIG. 5 further reveals that the top center piece 52 of the rail 5 can also be provided with openings 53, into which the locking pin 23 can be introduced. In this way, the running gear 1 can be fixed not only at the buffer device 3 provided with a locking element 36, but at various locations along the running path, at which openings 53 are provided in the rail 5.

Figure 7:
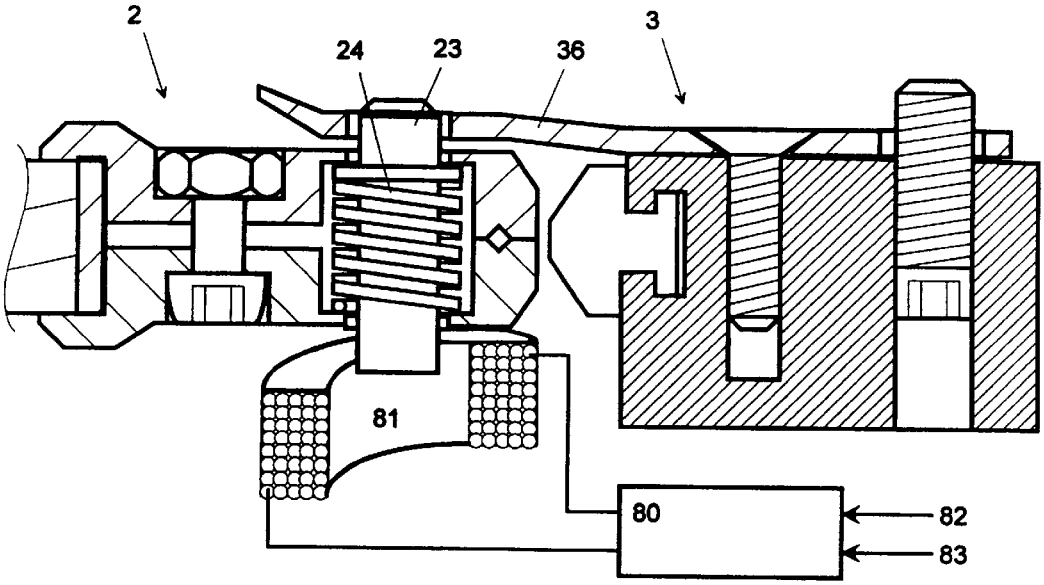
FIG. 7 shows the locking device 2 from FIG. 1 with an electromagnetically actuatable locking pin 23.

The actuation of the locking pin 23 is most simply carried out manually, as described above. As FIG. 7 reveals, however, electromagnetic actuation of the locking pin 23 is also possible. To this end, for example, a coil 81 surrounding the locking pin 23 is provided and can be supplied with a current from a control unit 80. The control unit 80 is connected to a supply line 82 and via a control line 83, for example, to a switch. In order to optimize the action of the force, the coil 81 is aligned obliquely, so that the locking pin 23 is enclosed to a great extent but, nevertheless, can move in laterally against the buffer device 3 without striking it. In this way, the locking devices 2 can be unlocked centrally, which is of great advantage in particular when the dividing elements are displaced by means of motors, which are likewise connected to the central control system.

Running gear 1 can also be provided with locking devices 2 on both sides. Normally, dividing elements 90 such as sliding doors, sliding counters or folding walls are guided by the running gear 1. However, the invention can also be advantageously used if other objects are connected to running gear 1.

Of course, running gear and buffer devices can also be implemented in various configurations.

List of reference symbols:

| | |
|---|---|
| 1 | Running gear |
| 11 | Running-gear body |
| 111 | Running-gear body with locking device 2 integrated |
| 1121 | First part of running-gear body 111 |
| 1122 | Second part of running-gear body 111 |
| 12, 13 | Wheels |
| 14 | Axials |
| 15 | Connecting screw |
| 2 | Locking device |
| 21 | First part |
| 22 | Second part |
| 23 | Locking pin |
| 231 | Collar |
| 232 | Cam |
| 24 | Spiral spring |
| 25 | Connecting means |
| 251 | Nut |
| 252 | Screw |
| 26 | Chamber |
| 261 | First opening in the chamber 26 |
| 262 | First flange on the chamber 26 |
| 263 | Second opening in the chamber 26 |
| 264 | Second flange on the chamber 26 |

-continued

List of reference symbols:

| | |
|---|---|
| 27 | Clamping elements |
| 28 | Mechanism |
| 281 | Retaining element |
| 29 | Means for fixing the parts 21, 22 on one side |
| 3 | Buffer device |
| 31 | Buffer element |
| 32 | Threaded hole for mounting screw 35 |
| 33 | Threaded hole for fixing screw 34 |
| 34 | Fixing screw |
| 35 | Mounting screw |
| 36 | Locking element |
| 361 | Hole for mounting screw 35 |
| 362 | Hole for fixing screw 34 |
| 363 | Opening for leading the locking pin 23 through |
| 37 | Resilient part of the buffer device 3 |
| 4 | Line |
| 5 | Rail |
| 51 | Running surfaces |
| 52 | Center piece |
| 53 | Opening |
| 80 | Control unit |
| 81 | Coil |
| 82 | Supply line |
| 83 | Control line |
| 90 | Dividing element |
| 91 | Fixing device |
| 901 | Door |
| 902–904 | Dividing elements |
| 905 | Hinges |
| 906 | Door lock |
| 1000 | Frame |

What is claimed is:

1. A device for locking running gear which is guided in a rail and is used for guiding dividing elements, wherein the locking device, which is connected to the running gear, has a body in which a locking pin is displaceably mounted and held resiliently in a first position by means of a resilient element, so that the locking pin is brought by the action of a force from the first position, in which the locking pin engages in a locking element provided in the rail or connected to the rail, into a second position, in which the locking pin is released from the engagement in the locking element.

2. The device as claimed in claim 1, wherein the body of the locking device (2) comprises two parts (21, 22) which have tongs-like clamping elements (27), by means of which the locking device (2) is firmly connected to the running gear (1) after the parts (21, 22) have been connected.

3. The device as claimed in claim 2, wherein the parts of the body of the locking device form a chamber serving to accommodate the locking pin after said parts of the body of the locking device have been joined together.

4. The device as claimed in claim 3, wherein the locking pin comprises a collar located within the chamber and emerges outside through openings in both parts of the body of the locking device, said openings having a smaller diameter than the chamber and are thus surrounded by a first flange and a second flange, wherein a spring element within the chamber encloses the locking pin, one end of the spring element is bearing on the first flange and an other end of the spring element is pressing the collar against the second flange, and the spring element holds the locking pin in the first position.

5. The device as claimed in claim 1, wherein the locking element is connected to a buffer device or to the rail or is part of the rail.

6. The device as claimed in claim 5, wherein the locking element that is connected to the buffer device has a plate-like or tongue-like configuration and is mounted in such a way that, after the locking device connected to the running gear has struck the buffer device, the locking pin penetrates into an opening provided in the locking element.

7. The device as claimed in claim 6, wherein the locking element is inclined upward in such a way that the locking pin moves in under the locking element, and presses the locking element upward, or the locking pin is pressed downward by the locking element until the locking pin penetrates into the opening.

8. The device as claimed in claim 1, wherein the locking pin is displaceable from the first position into a second position manually by means of a line or electromagnetically by means of a coil.

9. The device as claimed in claim 7, wherein the locking device is provided with a mechanism which retains the locking pin firmly in the second position until the locking pin is released again by means of renewed manual or electromagnetic actuation and is returnable to the first position.

10. The device as claimed in claim 1, wherein the running gear is provided with a locking device on both sides.

11. The device as claimed in claim 1, wherein parts of the running gear and of the locking device are produced from one piece.

12. The device as claimed in claim 1, wherein the chamber and the collar guided therein and belonging to the locking pin have a rectangular cross section.

* * * * *